US005676559A

United States Patent [19]

Laub et al.

[11] Patent Number: 5,676,559

[45] Date of Patent: Oct. 14, 1997

[54] ZERO INSERTION FORCE (ZIF) ELECTRICAL CONNECTOR

[75] Inventors: Michael Frederick Laub, Etters; David Joseph Goetzinger, Camp Hill; James Stover Hileman, Jr., Carlisle, all of Pa.

[73] Assignee: The Whitaker Corporation, Wilmington, Del.

[21] Appl. No.: 499,099

[22] Filed: Jul. 6, 1995

[51] Int. Cl.[6] ..... H01R 13/15

[52] U.S. Cl. ..... 439/260; 439/62; 439/636

[58] Field of Search ..... 439/259–265, 439/630–632, 325, 636, 637, 62, 67, 65, 66

[56] References Cited

U.S. PATENT DOCUMENTS

| | | | |
|---|---|---|---|
| 3,609,463 | 9/1971 | Laboue | 439/260 |
| 3,715,706 | 2/1973 | Michel et al. . | |
| 3,920,302 | 11/1975 | Cutchaw | 439/260 |
| 4,080,027 | 3/1978 | Benasutti . | |
| 4,261,631 | 4/1981 | Guilchev et al. | 439/260 |
| 4,552,420 | 11/1985 | Eigenbrode . | |
| 4,560,221 | 12/1985 | Olsson . | |
| 4,629,270 | 12/1986 | Andrews, Jr. et al. . | |
| 4,695,111 | 9/1987 | Grabbe et al. | 439/260 |
| 4,911,653 | 3/1990 | Walton et al. | 439/326 |
| 4,969,824 | 11/1990 | Casciotti | 439/62 |
| 5,240,420 | 8/1993 | Roberts | 439/62 |
| 5,277,592 | 1/1994 | Morlion | 439/65 |
| 5,306,160 | 4/1994 | Roberts | 439/62 |
| 5,308,249 | 5/1994 | Renn et al. | 439/62 |

*Primary Examiner*—Hien Vu

[57] ABSTRACT

A zero insertion force electrical connector (60) having a housing (61) which includes a support block (62) reciprocably mounted therein. The housing (61) also includes a contact array (65) with a plurality of contact elements (66,67) extending therefrom for electrical engagement with circuit traces (**63*a*,64*a*) on printed circuit boards (63,64). The contact array (65) includes a flexible etched circuit (76) thereon for signal transmission and impedance matching; and the contact elements (66,67) include arcuate sections (66*a*,66*b*,67*a*,67*b***) for ensuring compliancy, conformity, and contact wiping action at the electrical contact interfaces.

21 Claims, 5 Drawing Sheets

ZERO INSERTION FORCE (ZIF) ELECTRICAL CONNECTOR

The present invention relates to a Zero Insertion Force (ZIF) electrical connector for use with printed circuit boards (PCBs). More particularly, the present invention relates to an impedance matched ZIF connector which uses an electrical contact array having spring and contact elements in combination with an eccentric mechanism which moves the contacts of the electrical contact array into and out of engagement with a PCB.

BACKGROUND OF THE INVENTION

A known electrical connector for use with PCBs is disclosed in U.S. Pat. No. 4,552,420. This known connector requires separate spring members to be installed in grooves of a triangularly shaped housing, wherein the springs are arranged for biasing a flexible circuit against a motherboard PCB and a daughterboard PCB. This known connector utilizes a bolt and threaded hole combination to perform a biasing function thereby interconnecting various parts of the electrical connector. This known connector is advantageously capable of interconnecting a daughterboard with a motherboard; however, the use of the threaded bolt biasing mechanism is expensive and could result in damage to the daughterboard. Moreover, there is no contact wipe because the spring members are disposed in chambers which are covered by a planar section of flexible etched circuit (FEC).

A known electrical connector which utilizes spring members to interconnect circuit traces on a daughterboard and on a motherboard is shown in U.S. Pat. No. 3,715,706. This reference discloses discreet, bent spring elements which act as conductors between the daughterboard and the motherboard. In this design, however, the motherboard and daughterboard rely on the spring element conductors for electrical interconnection therebetween without the use of a FEC. This reliance creates an impedance problem for the overall electrical circuit thereby slowing the data transmission rate; and further problems can arise in that the spring element conductors can become loosened and thereby lose their electrical continuity with the circuit traces on the mother or daughterboards. Moreover, the interconnection with the daughterboard requires simple screw-fastening means and does not provide a way of disengaging the spring element conductor elements from the daughterboard short of altogether removing the daughterboard from the connector housing. Furthermore, since the spring conductor elements are formed individually, they must be individually inserted into slots formed in the connector housing which results in higher assembly costs.

Another known mother-to-daughterboard connector is shown in U.S. Pat. No. 5,308,249. This known connector provides an electrical contact array having arcuate portions formed in spring element members of the array wherein the arcuate portions include elastomeric members and are covered by an FEC. A pair of electrical contact arrays are arranged within a dielectric housing so that a daughterboard can be received therebetween. This known connector provides an advantageous way of interconnecting the circuit traces of a motherboard with those of a daughterboard; however, the interposition of elastomeric members between the spring elements and the FEC is an expensive solution. Moreover, although there is some degree of contact engagement sequencing, the design is relatively inflexible with respect to multiple sequencing application needs.

Another known electrical connector for connecting a daughterboard with a motherboard is shown in U.S. Pat. No. 4,560,221. This connector provides a ZIF arrangement with a cam actuating means for moving electrical contacts towards and away from a daughterboard. However, this design leaves the electrical contacts largely exposed to contaminants (e.g. dust), does not use an FEC for impedance matching, and provides but a minimum amount of contact wiping action. Moreover, the cam actuation means is cumbersome in operation and is an expensive manufactured item.

In view of the foregoing, the present invention seeks to overcome the deficiencies of prior art electrical connectors by providing a ZIF connector that:

- provides a high degree of contact wiping action between contact interface surfaces thereby removing contaminants and debris therefrom while providing protection against extrinsic environmental contaminants;
- provides an integral contact array part which is easy to manufacture and install within an electrical contact housing while providing long-term contact reliability and controlled normal force;
- achieves compliancy and conformity to non-planarities at contact interfaces without necessitating the use of elastomeric members;
- is easy for an operator to actuate and de-actuate with a relatively compact actuation means comprising an eccentric mechanism for urging the contacts into or out of electrical engagement with circuit traces on a daughterboard; and
- matches the electrical impedance of its electrical component source, thereby giving maximum signal transmission speed and transfer of energy from source to load, minimum signal reflection, and minimum signal distortion.

SUMMARY OF THE INVENTION

The present invention provides electrical connector for electrically interconnecting printed circuit boards having circuit traces formed thereon, the connector comprising: a housing having a recess therein for receiving a support block therein; a support block received in the housing recess, and the support block includes a mechanism for moving the support block between advanced and retracted positions relative to the housing; the connector includes at least one electrical contact array operatively disposed between the printed circuit boards, the contact array includes at least one contact element which extends from the array; and at least one contact element is operable to be electrically engaged or disengaged with at least one circuit trace of the respective printed circuit boards as the support block is moved between the advanced and retracted positions. Additionally, the connector is provided with an FEC for the purpose of conducting signals and for impedance matching the connector with the electrical system in which it is used.

BRIEF DESCRIPTION OF THE DRAWINGS

FIG. 3 shows a second embodiment of the present invention in a cross sectional view depicting an electrical contact array with an FEC bonded thereto.

DETAILED DESCRIPTION OF THE INVENTION

Figures 1, 2, 2A:
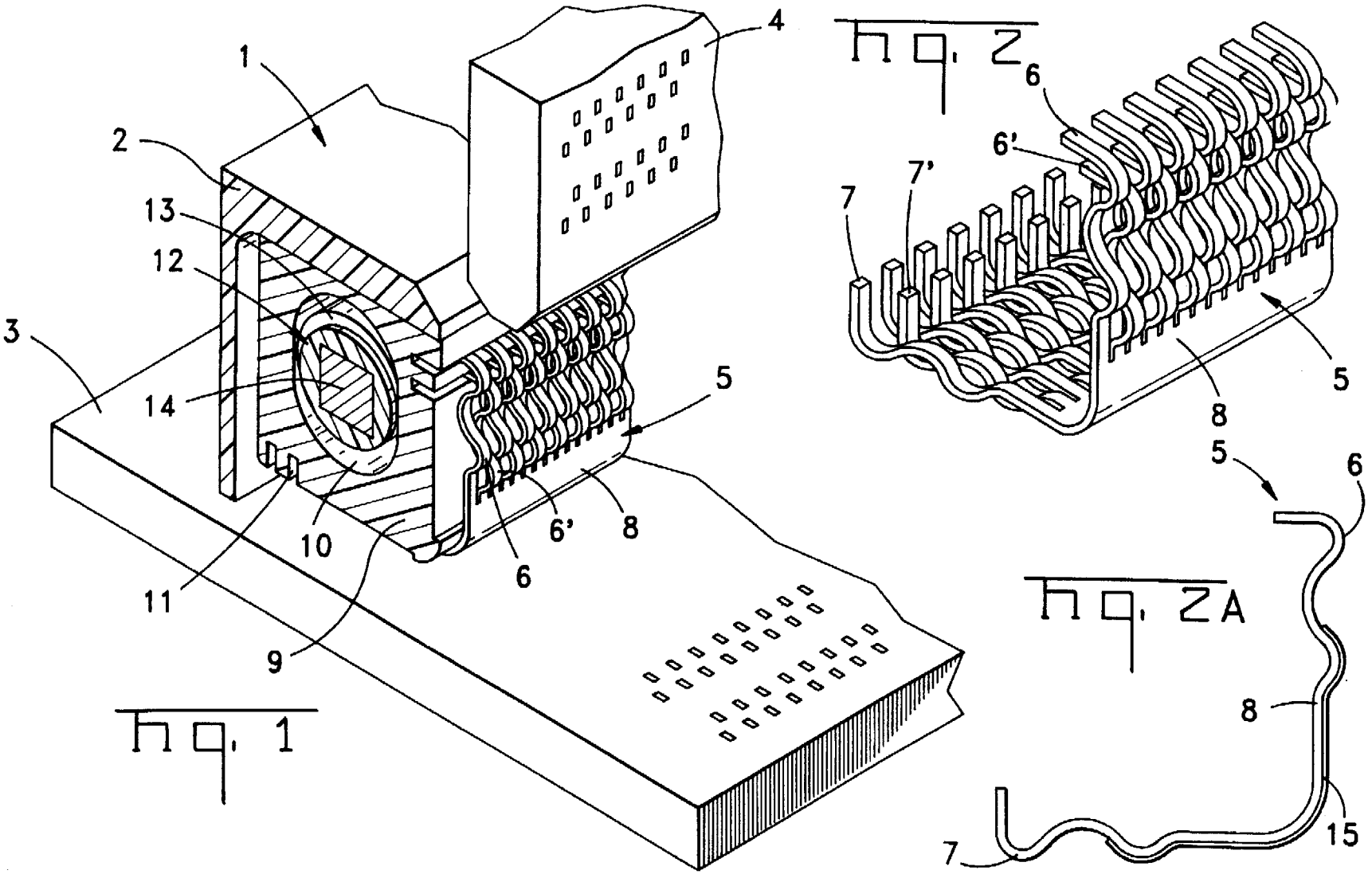
FIG. 1 is an isometric view of one half of the ZIF connector according to the present invention which is installed on a motherboard and with a daughterboard disposed for connection to the invention.
FIG. 2 shows an isometric view of the electrical contact array part of FIG. 1.
FIG. 2A shows an enlargement of the contact array of FIG. 2.
Figure 1:
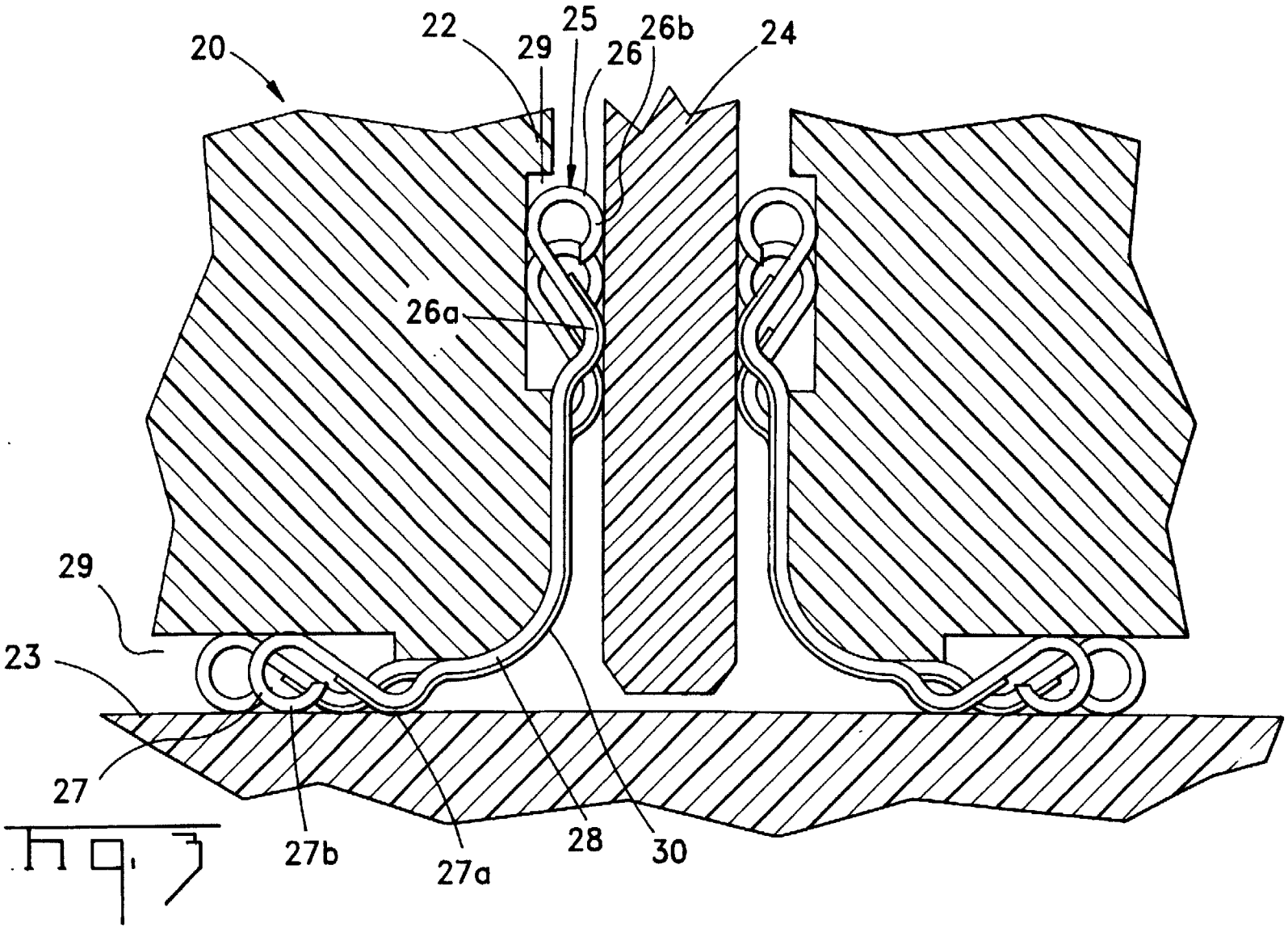

FIG. 1 shows an electrical connector 1 according to the present invention which represents a first embodiment thereof. Connector 1 is a ZIF connector with a housing 2 mounted on a motherboard 3, a daughterboard 4, and a contact array 5 disposed on a reciprocable support block 9. Support block 9 includes a generally oval aperture 10 wherein an eccentric mechanism 12 is installed which includes an eccentric portion 13 and a rotatable shaft 14. Contact array 5 is shown including side contact elements 6,6' whereby element 6' is staggered relative to contact element 6. Support block 9 also includes grooves 11 for slidably receiving end portions of contact array 5.

FIG. 2 shows the contact array 5 of FIG. 1. The contact array 5 is formed of a metallic spring material and includes a sheet portion 8 from which side contact elements 6,6' extend and from which bottom contact elements 7,7' extend. The contact elements 6,6' and 7,7' impart compliancy and controlled normal force to the contact interface as well as contact wiping action, as will be further described below. The end portions of contact elements 6,6' and 7,7' extend into grooves 11 of support block 9 when the contact array 5 is installed on support block 9. This advantageously slidably fixes the contact array 5 to the support block 9 so that when the eccentric mechanism 12 is activated by rotation of shaft 14 the support block 9 will move relative to housing 2 towards daughterboard 4 so that side contact elements 6,6' will come into electrical engagement with circuit traces on the daughterboard 4. Additionally, as is best shown in FIG. 2A, contact array 5 will have an FEC 15 bonded thereto for conducting electrical signals between the motherboard 3 and daughterboard 4.

Referring to FIG. 3, a second embodiment of the present invention is shown which includes a pair of contact arrays 25. In this drawing the eccentric mechanism as shown in FIG. 1 is omitted, but it is understood that the embodiment of FIG. 3 will preferably have an eccentric mechanism for moving housing 22 towards and away from daughterboard 24. Each contact array 25 includes a side contact element 26 having an arcuate section 26*a* and a spring section 26*b*. The contact arrays 25 also include a bottom contact element 27 with an arcuate section 27*a* and a spring section 27*b*. Sheet portion 28 is formed to complement the outer contour of an adjacent section of housing 22. Housing 22 also includes grooves 29 for receiving the arcuate sections of contact elements 26 and 27. Motherboard 23 is shown along the bottom of the electrical connector generally perpendicular to daughterboard 24.

As shown in FIG. 3, an FEC 30 is bonded to the respective contact arrays 25 and includes circuit traces thereon for engaging circuit traces of motherboard 23 and circuit traces of daughterboard 24. The bond is preferably made by a time-temperature sensitive adhesive rather than a pressure sensitive adhesive. The FEC 30 can be made in a micro-strip configuration which ensures a high speed, impedance-matched performance capability. It should be noted that it is preferred that the spring sections 26*b* of side contact element 26 will engage the daughterboard 24 and thereby support and retain the daughterboard in place with spring compliance. Moreover, as the circuit traces of daughterboard 24 press against arcuate section 26*a*, which section is covered with a portion of FEC 30, contact wiping action occurs thereby removing any debris or oxidation from the electrical circuit interface. The same holds true for arcuate sections 27*a* of bottom contact element 27, that is, contact wiping action occurs between the circuit traces of the FEC 30 and the circuit traces on motherboard 23. Moreover, the spring section 27*b* of bottom contact element 27 will biasingly engage the motherboard 23 and the wall of groove 29 so that forces coming from the motherboard are balanced so that spring section 27*b* will carry a proportionately greater load than arcuate section 27*a*, thereby controlling the contact forces and ensuring compliance and conformance to the electrical contact interface. This is likewise true of the force balance with respect to side contact element 26 and daughterboard 24. Additionally, advantageous contact wiping action is assured between the contact array 25 and the circuit traces of the motherboard 23 and daughterboard 24.

Figure 4:
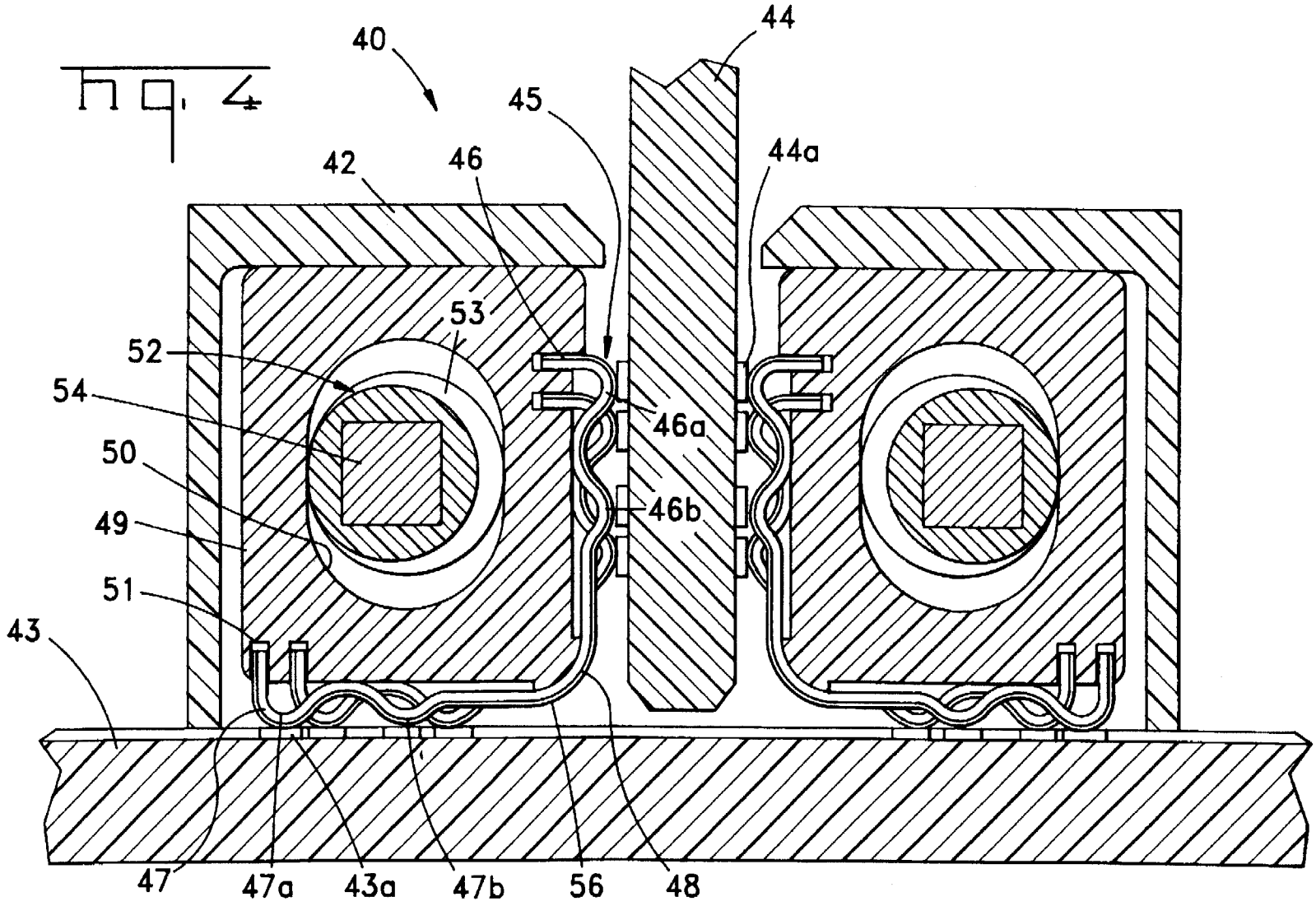
FIG. 4 shows a further embodiment of the present invention including an electrical contact array with an FEC bonded thereto and shows the eccentric mechanism in the actuated position.

FIG. 4 shows a full cross-sectional view of a ZIF connector 40 according to another embodiment of the present invention. ZIF connector 40 includes a housing 42 mounted to a motherboard 43 having circuit traces 43*a*, and the housing 42 is arranged adjacent to daughterboard 44 having circuit traces 44*a* thereon. ZIF connector 40 includes contact arrays 45 each including: side contact elements 46 with an upper section 46*a* and a lower section 46*b*; a bottom contact element 47 with an arcuate section 47*a* and an arcuate section 47*b*; and the side contact elements 46 and 47 are joined together by a sheet portion 48. The contact array 45 is mounted on support block 49 such that end sections of the contact elements 46 and 47 are slidably disposed in respective grooves 51 of support block 49 whereby small gaps exist between the ends of side contact elements 46 and 47. These gaps allow some degree of array flexibility as the motherboard pushes on contact elements 47 and the daughterboard pushes on contact elements 46 thereby forcing the ends thereof into the respective grooves 51.

Support block 49 also includes oval-shaped aperture 50 which receives an eccentric mechanism 52 therein having an eccentric surface 53 and a shaft 54. As shown in FIG. 4, the eccentric surface 53 is rotatably engaged with a flat side of the aperture 50 and thereby causes the contact elements 46 to engage the circuit traces of daughterboard 44. Thus FIG. 4 shows the present invention in an actuated state. FEC 56 is shown bonded to the contact array 45 so that signals are transmitted between the circuit traces 43*a* of motherboard 43 and the circuit traces 44*a* of daughterboard 44.

In operation, the operator rotates shaft 44 which causes eccentric surface 53 to engage the flat side wall of aperture wall 50 thereby forcing support block 49 towards the daughterboard 44. As this occurs, upper and lower arcuate sections 46*a* and 46*b* will come into electrical contact with respective circuit traces 44*a* of daughterboard 44. This causes the contour of contact element 46 to be deflected, as a support section 46*c* of the contact element 46 is pressed by the support block 49 thereby causing flexure and wiping action as arcuate upper and lower sections 46*a* and 46*b* wipe against the circuit traces of 46a of daughterboard 44. Once activated, the circuit traces of the FEC 56 will remain in engagement with circuit traces 44a by virtue of the compliancy and controlled normal forces of the contact array 45.

Additionally, contact wiping action occurs as the support block 49 moves towards daughterboard 44 as the arcuate sections 47a and 47b of contact element 47 slide across the surfaces of respective circuit traces 43a of motherboard 43. Additionally, some wiping action occurs as the connector 40 is placed on the motherboard 43 and as the support block 49 pushes on support section 47c of contact element 47. Thus all electrical interface surfaces of ZIF connector 40 will undergo a degree of contact wiping action, conformancy, and compliancy; further, the circuit traces of FEC 56 will be resiliently biased against the circuit traces of the motherboard and daughterboard within a controlled normal force range.

Figure 7:
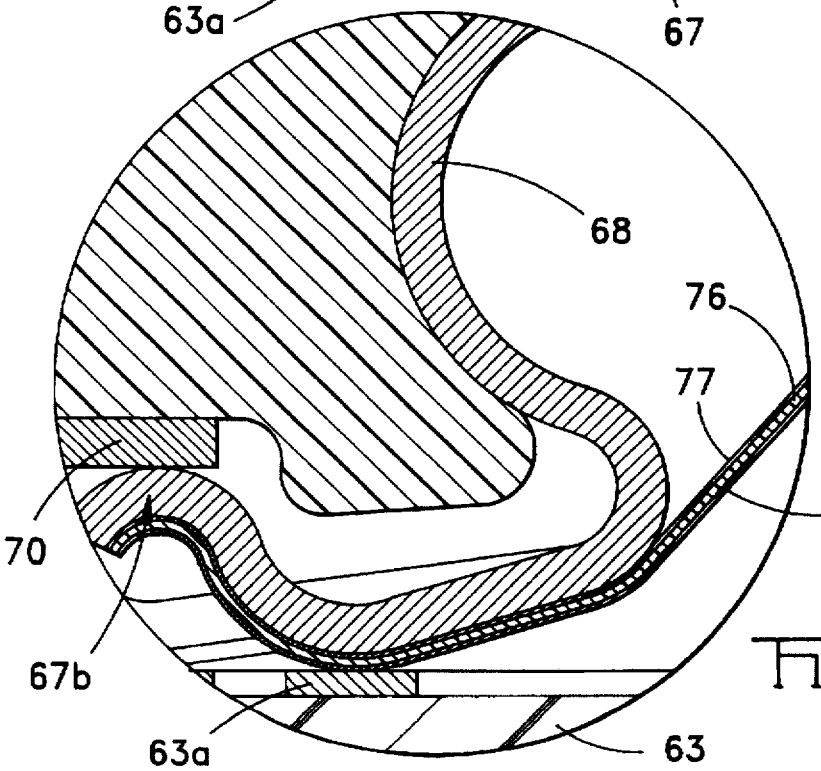
FIG. 7 shows a closeup view of a portion of the omega-shaped contact array thereby showing an FEC having: a ground plane on one side for engaging the contact, and circuit traces on the other side thereof for engaging circuit traces of the motherboard and daughterboard.

Now referring to FIG. 5, a further embodiment of the present invention showing a ZIF connector 60 will be described. ZIF connector 60 includes a housing 61 with a referencing peg 62a and a reciprocable support block 62 disposed within the housing 61. The connector 60 is mounted on a motherboard 63 having circuit traces 63a, and connector 60 is adjacent to a daughterboard 64 having circuit traces 64a thereon and a hole 64b for receiving referencing peg 62a of support block 62. A contact array 65 is mounted on support block 62 and includes side contact elements 66, bottom elements 67, and sheet portion 68. Grooves 69 formed in support block 62 fixably receive end portions of the lower secondary elements and upper secondary contact elements 70,71, respectively. An eccentric mechanism 72 is disposed in an aperture 73 of support block 62 for moving the support block towards and away from daughterboard 64. Eccentric portion 75 is adapted to engage an inner wall of aperture 73 thereby moving the support block 62 towards the daughterboard 64. An FEC 76 is bonded to side and bottom contact elements 66,67. As best shown in FIG. 7, the FEC 76 includes a ground plane 77 on one side and signal traces 78 on the other side.

In operation, the ZIF connector 60 is placed on the motherboard 63 so that the circuit traces 78 of FEC 76 engage the circuit traces 63a of motherboard 63. The lower secondary elements 70 are arranged to engage the respective traces 63a on the motherboard as well. Additionally, the bottom contact elements 67 include an arcuate portion 67b which electrically engages the lower secondary element 70, thereby completing the ground path from a respective ground trace on the motherboard 63 through the lower secondary element 70 and the bottom contact element 67 which is in electrical engagement with the ground plane 77 of FEC 76.

As the support block 62 is moved towards the daughterboard, upper secondary element 71 will engage circuit traces 64a of daughterboard 64. Side contact elements will engage respective circuit traces on the daughterboard 64 which thereby forces the side contact element 66 into electrical engagement with upper secondary elements 71. A ground path is thus established between upper secondary element 71, a ground trace on daughterboard 64, and the side contact element 66 which has the ground plane 77 electrically bonded thereto. On the other hand, signal transmission is achieved by engagement of circuit traces 78 on the FEC 76 and engagement with the respective circuit traces 63a and 64a of the mother and daughterboards 63,64, respectively.

As the support block 62 is moved into engagement with the daughterboard 64, peg 62a will register with aperture 64b of the daughterboard 64, thereby supporting the daughterboard and aligning the circuit traces of board 64 with respective positions on the FEC circuit 76. As the engagement and contact element deflection occurs, omega-shaped portions 68 of contact arrays 65 remain snugly disposed in their respective recesses of housings 61, thereby anchoring each array 65 to a housing 61.

The electrical interface surfaces of lower and upper secondary elements 70,71, and side and bottom contact elements 66,67, will undergo a degree of contact wiping action, conformancy, and compliancy. Furthermore, the circuit traces 78 of FEC 76 will be resiliently biased against the circuit traces of the motherboard 64 and daughterboard 63 within a controlled normal force range.

Figure 5:
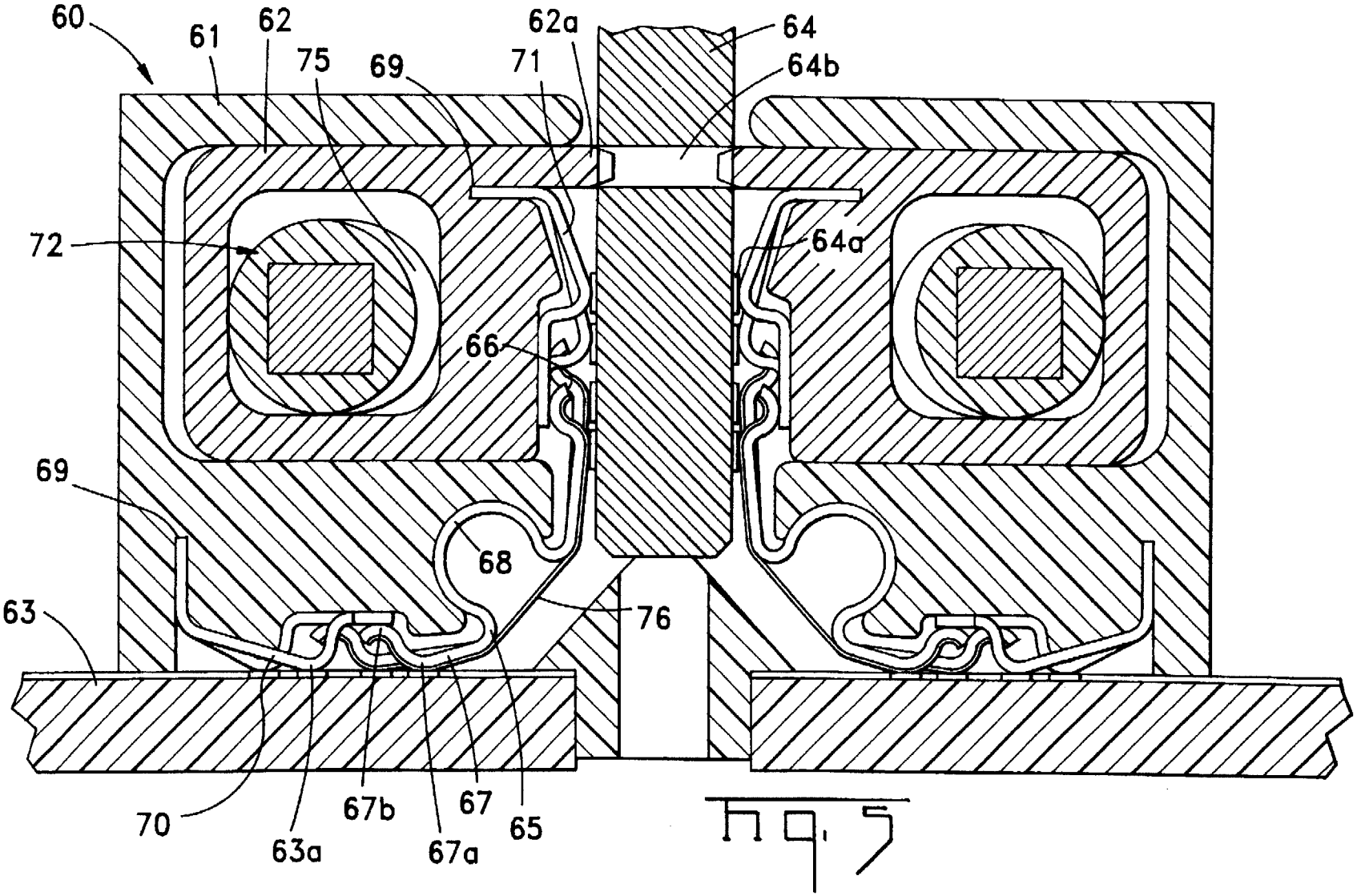
FIG. 5 shows another embodiment of the present invention including omega-shaped, electrical contact arrays and an eccentric mechanism in an actuated position.
Figure 6:
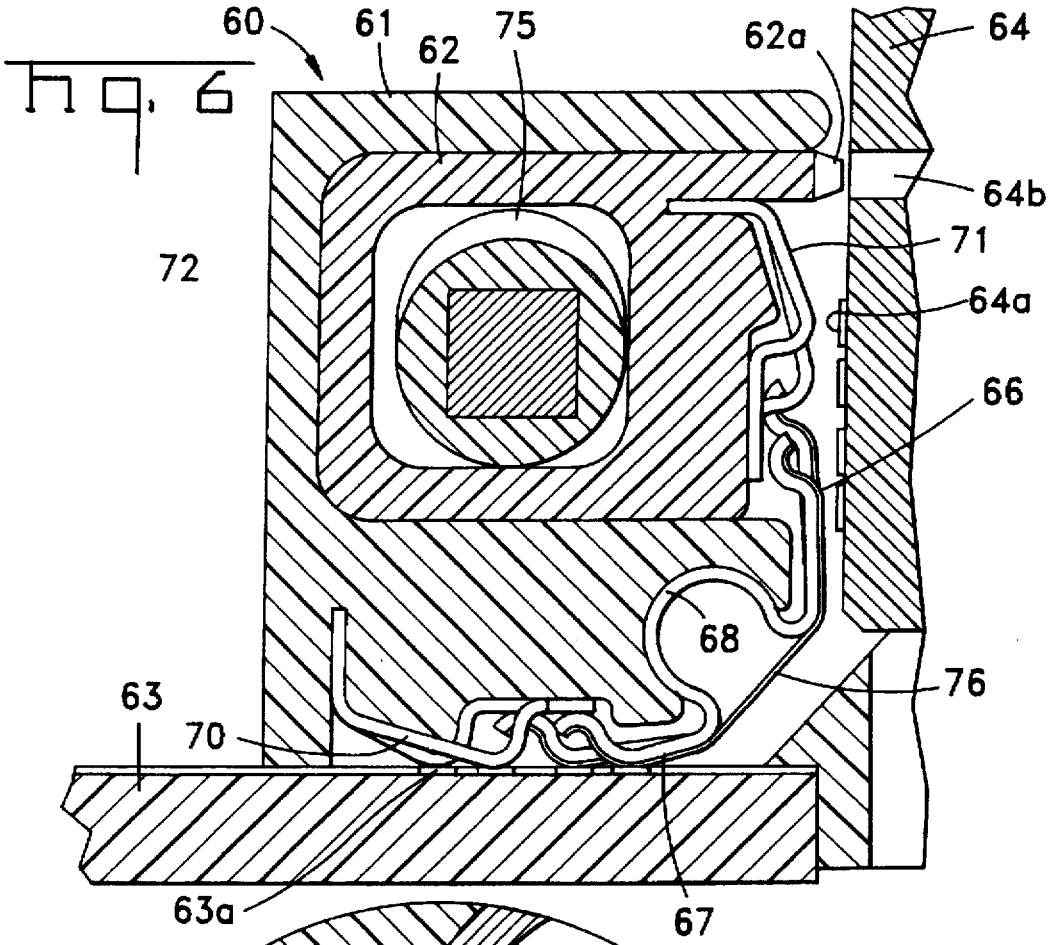
FIG. 6 shows the ZIF connector of FIG. 5 with the eccentric mechanism in the de-actuated position.

FIG. 6 shows a cross sectional view of half of the ZIF connector 60 of FIG. 5. In this view, however, the support block 62 is in a retracted position whereby the eccentric portion 75 is disposed in an upwardly extending direction and the upper secondary elements 71 have been withdrawn from circuit traces 64a on daughterboard 64. Side contact elements 66 have also been withdrawn from electrical engagement with respective circuit traces on the daughterboard 64. Upper elements 71 can extend further to the right, as shown in FIG. 6, than side contact elements 66 if the particular sequencing of the circuit requires ground contact to be made first, for example, for the purpose of discharging static electricity from the circuit.

Referring again to the embodiments of FIGS. 5–7, when peg 62a registers with hole 64b of daughterboard 64, it creates a constant deflection condition for the side contact element 66 and upper secondary element 71, independently of daughterboard thickness. Since the connector 60 is preferably of a modular design, the location of the peg 62a in hole 64b imparts locationing to the daughterboard which allows each module of the connector 60 to be referenced independently of other modules. It should also be noted that embossment 80 of ZIF connector 60 is disposed in an aperture 82 of motherboard 63 thereby providing a firm footing for the ZIF connector 60 on the motherboard 63. Additionally, although aperture 73 is shown in a square configuration, it could be splined, elliptical, or hexagonal in shape. The aperture feature allows for differing eccentric or cam profiles for a given module which would allow for varying the contact closure and opening sequence, i.e. for ground interconnection followed by signal interconnection followed by the application of power. Moreover, it is contemplated that the modules for the ZIF connector 60 can be constructed without any FEC 76 used whatsoever, i.e. with only plated spring metal contacts. This option allows the possibility of using high-current power or ground contacts with multiple redundant contact points.

The ideal engineering materials for the electrical contact arrays disclosed will comprise metals having sufficient spring characteristics, high strength, high conductivity, and a low cost. For example, such metals as copper, brass, bronze, beryllium copper, copper alloys, steel, nickel, aluminum, and zinc. Additionally, it is preferred that the above described contact arrays comprise a stamped and formed work piece; however, other methods may be used to form the contact array as well. It is further contemplated that the electrical contact arrays can be coated or plated for corrosion resistance. The housing and support blocks are preferably formed of a suitable dielectric material, and the FEC is preferably formed of a polyimide material with a suitable conductive material(s) deposited thereon by, for example, a photo-etching process.

Thus, while preferred embodiments of the invention have been disclosed, it is to be understood that the invention is not to be strictly limited to such embodiments but may be otherwise variously embodied and practiced within the scope of the appended claims. For example, although a ZIF design has been disclosed, it is contemplated that the present invention is equivalently adaptable for use with electrical connectors with some degree of contact insertion force.

Accordingly, what is claimed is:

1. An electrical connector for electrically interconnecting printed circuit boards having circuit traces formed thereon, said connector comprising:

a housing having a recess therein for receiving a support block therein;

a support block received in said housing recess, said support block includes a mechanism for moving said support block between advanced and retracted positions relative to said housing;

said connector includes at least one electrical contact array operatively disposed between said printed circuit boards, said contact array includes a sheet portion from which a plurality of contact elements extend, a flexible circuit being disposed on said electrical contact array and on said plurality of contact elements, the flexible circuit being separated between individual ones of said plurality of contact members, said plurality of contact elements comprise a staggered configuration between pairs of contact elements; and at least one of said plurality of contact elements is operable to be electrically engaged or disengaged with at least one circuit trace of said printed circuit boards as said support block is moved between said advanced and retracted positions.

2. The electrical connector of claim 1, wherein said mechanism comprises an eccentric mechanism.

3. The electrical connector of claim 1, wherein said mechanism is located in an aperture formed in said support block.

4. The electrical connector of claim 1, wherein said array includes a second contact element extending therefrom.

5. The electrical connector of claim 4, wherein said second contact element moves with said support block thereby causing contact wiping action.

6. The electrical connector of claim 4, wherein said second contact element is fixed to said housing.

7. The electrical connector of claim 1, wherein said at least one contact element comprises a compliant beam with an arcuate contact section.

8. The electrical connector of claim 7, wherein said at least one contact element comprises a plurality of arcuate sections.

9. The electrical connector of claim 1, wherein said support block includes at least one groove for receiving a contact element therein.

10. The electrical connector of claim 9, wherein said groove has a contact element fixedly disposed therein.

11. The electrical connector of claim 9, wherein said groove has a contact element slidably disposed therein.

12. The electrical connector of claim 1, wherein said sheet portion is generally L-shaped.

13. The electrical connector of claim 1, wherein said sheet portion is generally omega-shaped.

14. The electrical connector of claim 1, wherein the flexible circuit provides impedance matched with electrical components of an electrical system.

15. An electrical connector for electrically interconnecting printed circuit boards having circuit traces formed thereon, said connector comprising:

a housing having a recess therein for receiving a contact array therein;

said connector includes at least one electrical contact array operatively disposed between said printed circuit boards, said contact array includes a sheet portion from which a plurality of contact elements extend, a flexible circuit being disposed on said electrical contact array and on said plurality of contact elements, the flexible circuit being separated between the individual ones of said plurality of contact elements, said plurality of contact elements comprise a staggered configuration between pairs of contact elements; and said contact elements are operable by a mechanism to provide electrical engagement with at least one circuit trace of said printed circuit boards.

16. The electrical connector of claim 15, wherein the connector array has flexible etched circuit disposed thereon, the contact elements push the flexible etched circuit into contact with at least one circuit trace of said printed circuit boards, the flexible etched circuit forming at least one electrical connection of the electrical engagement.

17. The electrical connector of claim 16, wherein the contact elements comprise a compliant beam with an arcuate contact section.

18. The electrical connector of claim 17, wherein the contact elements comprise a plurality of arcuate sections.

19. The electrical connector of claim 15, wherein said sheet portion is generally L-shaped.

20. The electrical connector of claim 15, wherein said sheet portion is generally omega-shaped.

21. The electrical connector of claim 15, wherein the flexible circuit provides impedance matched with electrical components of an electrical system.

* * * * *